US006356237B1

(12) United States Patent
Kim

(10) Patent No.: US 6,356,237 B1
(45) Date of Patent: Mar. 12, 2002

(54) ANTENNA FOR MOBILE COMMUNICATIONS

(76) Inventor: Young Joon Kim, 101-803 Anam Apt., Myungriun-dong 2-4, Chongro-ku, Seoul 110-522 (KR)

( * ) Notice: Subject to any disclaimer, the term of this patent is extended or adjusted under 35 U.S.C. 154(b) by 0 days.

(21) Appl. No.: 09/700,025

(22) PCT Filed: Jun. 16, 1999

(86) PCT No.: PCT/KR99/00306

§ 371 Date: Nov. 9, 2000

§ 102(e) Date: Nov. 9, 2000

(87) PCT Pub. No.: WO99/66590

PCT Pub. Date: Dec. 23, 1999

(30) Foreign Application Priority Data

Jun. 17, 1998 (KR) ..... 98-22805
Apr. 30, 1999 (KR) ..... 99-15601

(51) Int. Cl.[7] ..... H01Q 1/32
(52) U.S. Cl. ..... 343/713; 343/715; 343/906
(58) Field of Search ..... 343/702, 713, 343/715, 841, 906, 790, 791, 792

(56) References Cited

U.S. PATENT DOCUMENTS 5,105,199 A * 4/1992 Ukmar ..... 343/791
5,446,473 A * 8/1995 Nielsen ..... 343/890
6,104,355 A * 8/2000 Wilson ..... 343/749

* cited by examiner

*Primary Examiner*—Tan Ho
(74) *Attorney, Agent, or Firm*—Antonelli, Terry, Stout & Kraus, LLP

(57) ABSTRACT

An antenna is provided for mobile communications. The antenna comprises first, and second bodies of a conductor, each having races whose length and diameter are designed in consideration of the antenna's frequency and gain characteristics; a spacer of a non-conductor interposed between the first and second bodies so as to keep a given space between the respective races of the first and second bodies according to the frequency and gain characteristics; an inner core fixing two bodies to each other with screwed parts respectively inserted into screwed grooves each passing through the races' bottom, and electrically connecting the first body to the second body; and a coupling part for feeder connection of a transmitting/receiving circuit for a mobile communications terminal.

16 Claims, 10 Drawing Sheets

ANTENNA FOR MOBILE COMMUNICATIONS

TECHNICAL FIELD

The present invention relates to an antenna for mobile communications. More particularly, it relates to an antenna for mobile communications that has an outer length significantly reduced in comparison to a conventional antenna's, and assures greatly improved performance.

BACKGROUND ART

In recent years, mobile communications equipments have spread far and wide. They became small in size gradually, and much effort has been made into the development of the quality of communication service. There are various mobile communications equipments, and particularly, there are terminals for mobile communications using code-division multiple access (CDMA), time-division multiple access (TDMA), or frequency-division multiple access (FDMA), and iridium terminals using a communications satellite. In these terminals, their antennas are very important parts for keeping good quality of communication service.

Such an antenna should basically have a voltage standing wave ratio (VSWR) of about 1.0, a high gain, a low radio-frequency resistance (RFR), a high emissivity, and a low reflection factor. It is advantageous that the antenna is long in order to increase the gain. When it is too long, its RFR becomes high, and its gain is significantly reduced. Besides, the long antenna gives a user inconvenience.

The antenna used for the conventional terminal for mobile communications is one using a loading coil. Because of the relation of the antenna's length and gain, there is a limit to the antenna's length, and if the antenna is mounted within the terminal body, its performance becomes deteriorated to lower the quality of communication service. Hence, the antenna is not embedded in the terminal but protrudes to the outside. Recently, the mobile communications terminal becomes small and light, but its antenna cannot be decreased in size. The protruding antenna may be easily broken or damaged, and when a user carries the terminal in his or her pocket, its antenna that may be caught causes inconvenience to the user for putting it into the pocket or drawing it therefrom.

In addition, since the projecting antenna comes to be near the user's head during use, the electromagnetic waves that are produced therefrom are deleterious to the human body, and when it contacts the human body, the terminal's characteristics can be changed to cause noise or cut-off in the middle of telephone communication.

If a cellular phone is installed on an automotive vehicle, an antenna for vehicle cellular phone is provided. However, in the conventional antenna for vehicle cellular phone, its position, direction and length are just controlled in order to enhance the quality of communication service, and this conventional technique could not fundamentally improve the quality of communication service.

The problems of the conventional antenna will be now described referring to FIG. 1.

As depicted in FIG. 1, the conventional antenna is installed on either the front side of an automotive vehicle or the window of its rear side and then connected to a coaxial cable provided to the vehicle's interior. The conventional antenna is of on-glass type, and this type is a coupling one, and its radio-frequency interference (RFI) is abruptly decreased during real use to deteriorate the quality of communication service and easily cut off the telephone conversation. In addition, this antenna becomes about 53 cm in length when spreading its coil part. When the antenna becomes long like this, the VSWR can be easily controlled but the RFR is increased to lower the quality of communication service. The conventional antenna's gain is about 0 to 0.4 dBi, and the VSWR is 1.4 to 1.5. Another conventional antenna has low productivity and is of complicated structure.

DISCLOSURE OF THE INVENTION

Accordingly, the present invention is directed to an antenna for mobile communications that substantially obviates one or more of the problems due to limitations and disadvantages of the related art.

A first object of the present invention is to provide an antenna of new structure which assures high gain characteristics and improved voltage standing wave ratio (VSWR) with short length, thus enhancing the quality of communication service.

A second object of the present invention is to provide an antenna that is installed within a case of a cellular phone.

A third object of the present invention is to provide an antenna that is used to be mounted on an automotive vehicle or vessel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides an antenna for mobile communications including first and second bodies of conductor, each having races whose length and diameter are designed in consideration of the antenna's frequency and gain characteristics; a spacer of a non-conductor interposed between the first and second bodies so as to keep a given space between the respective races of the first and second bodies according to the frequency and gain characteristics; an inner core fixing two bodies to each other with screwed parts respectively inserted into screwed grooves each passing through the races' bottom, and electrically connecting the first body to the second body; and a coupling part for feeder connection of a transmitting/receiving circuit for a mobile communications terminal.

The inventive antenna can be embedded in a cellular phone terminal to solve inconvenience that occurs by conventional protruding antennas for cellular phone terminal.

An antenna anode region is formed with this inventive antenna installed within the terminal's case and the coupling part for feeding to one body, and an antenna anode is formed by a shield plate of the cellular phone.

In addition, two antennas of basic structure are installed in the case and one of the antennas serves as a feeder while the other one is an anode region.

In installing the antenna within the terminal, the antenna is disposed outside of the shield plate in a certain direction. When forming the cathode region in the same structure as the anode region's, two regions can be arranged in the same direction, and the anode region may make a right angle to the cathode region. In addition, each of the antenna coupling part and the antenna connector has a pin hole, and they may be connected to each other by using a pin or via bolt-nut.

The inventive antenna's gain is higher than conventional ones, thereby enhancing the performance. Since the antenna for a cellular phone terminal is installed in the terminal's case, this terminal can be variously designed, and obviates any inconvenience that may occur by the projecting antenna.

According to another aspect of the present invention, an antenna includes an antenna base having a through hole into which an antenna cable for communications equipment is inserted, and a plurality of screw holes formed on its bottom to mate with fixing brackets; a connector having a bolt portion joined to the through hole's upper section, and a connector pin protruding to the bolt portion's upper and lower parts, a part of the bolt portion being screwed to the through hole of the antenna base, and the antenna cable, inserted into the antenna base, being electrically connected to the connector pin protruding to the lower part; a holder of an insulating material, screwed to the bolt portion of the connector protruding to the upper part of the antenna base, and precisely controlling a minute space between the bolt portion's upper section and an antenna body for regulating the antenna's capacitance; a first body having a bolt portion protruding from its lower portion and joined to the holder, the bolt portion having a pin hole into which a connector pin projecting to the connector's upper part is inserted for electrical connection, and a race of a given depth designed according to the antenna's transmitting/receiving frequency and gain, the race having screwed grooves on its bottom; an inner core having one end screwed to the screwed grooves, and spaced a given distance away from the inner surface of the first body's race; a holder of cylindrical shape having a through hole through which the inner core passes, and formed of an insulating material keeping a space of the first and second bodies, designed according to the antenna's transmitting/receiving frequency and gain; and a second body having a race corresponding to the first body's, screwed grooves formed on its inner upper section, for receiving the inner core, and a cap formed on its outer upper section.

Each of the fixing brackets includes a fixing disk, corresponding to the bottom of the antenna base, having a plurality of screw holes to which screws are fastened, a cable guide hole formed to receive the antenna cable, and a coupling part formed on one side of the fixing disk to be curved by a given angle (e.g. right angle) and divided into two by an open slit connected to the guide hole in such a manner that the first and second fixing brackets, elastic pieces with compressed elastic force being attached to the coupling part of the first fixing bracket, and the second fixing bracket's coupling part having a coupling slot into which the elastic pieces of the first fixing bracket are fitted, so that the brackets may be either fixedly inserted into a gap of a car's interior into which the fixing disk can be fitted, or fixedly installed inside or outside of the car by using screws.

It is to be understood that both the foregoing general description and the following detailed description area exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the drawings:

In the drawings:

FIG. 3A shows the coupling structure using a screw, and FIG. 3B illustrates the pin-coupling structure;

BEST MODE FOR CARRYING OUT THE INVENTION

Reference will now be made in detail to the preferred embodiments of the present invention, examples of which are illustrated in the accompanying drawings.

Figure 2A:
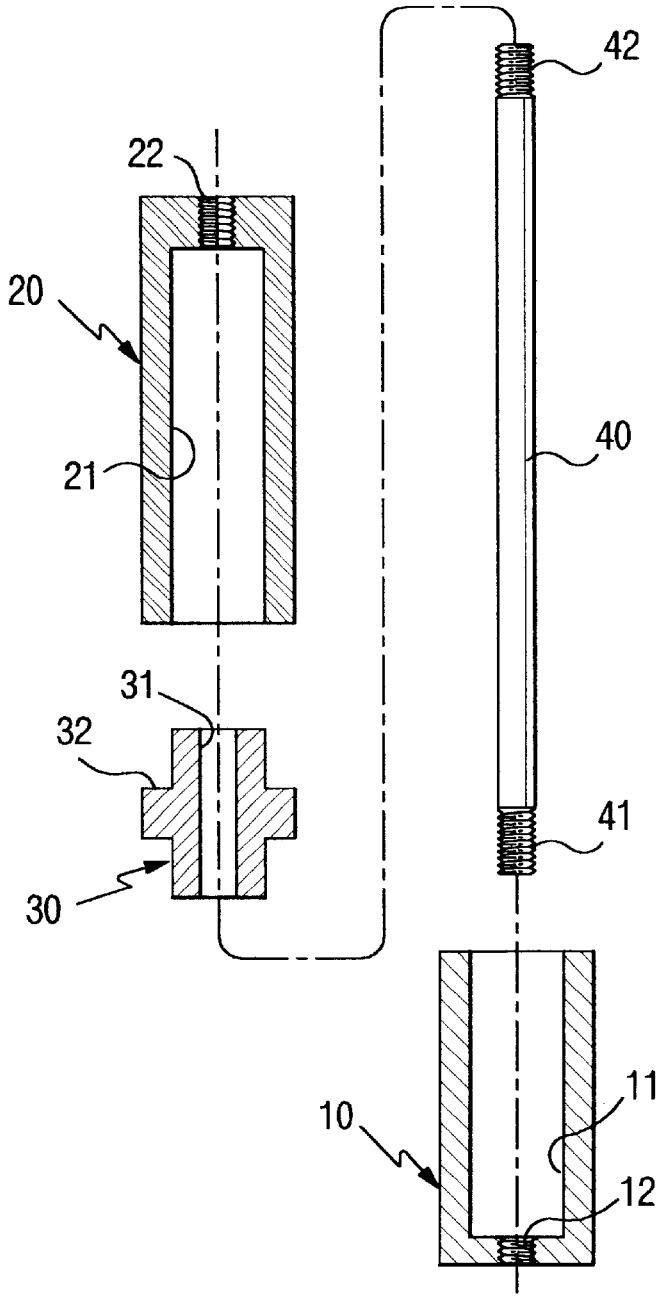
FIG. 2A is an exploded sectional view of an antenna in accordance with the present invention.
Figure 2B:
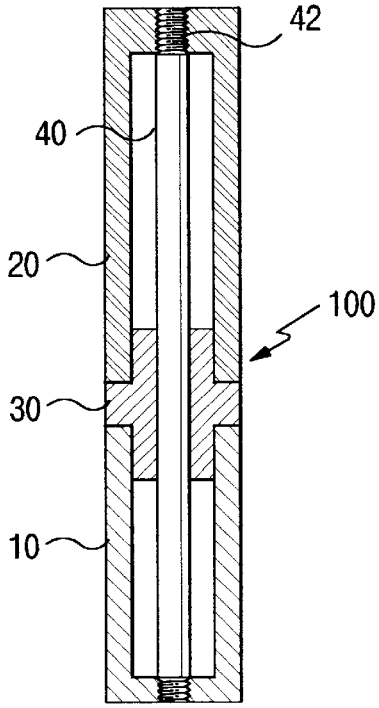
FIG. 2B is a sectional view of the assembled antenna in accordance with the present invention.

FIGS. 2A and 2B depict the structure of an antenna in accordance with the present invention. Specifically, FIG. 2A is an exploded sectional view of an antenna in accordance with the present invention, and FIG. 2B is a sectional view of the assembled antenna in accordance with the present invention.

As shown in the drawings, the inventive antenna includes first and second bodies 10 and 20 each having races 11 and 21 whose length and diameter are fixed in consideration of the antenna's frequency and gain; a spacer 30 of non-conductor interposed between first and second bodies 10 and 20 to keep a given interval between races 11 and 21; and an inner core 40 with screwed parts 41 and 42, each formed on its both tips and fixedly coupled to respective screwed grooves 12 and 22 of races 11 and 21, thus fixing bodies 10 and 20 and electrically connecting first body 10 to second body 20.

Figure 3A:
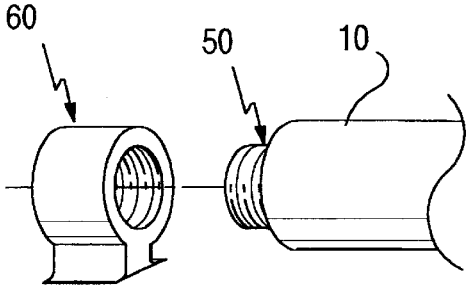
FIGS. 3A and 3B depict the coupling structure of the inventive antenna.

In case where such an antenna is installed within a cellular phone's case, a coupling part has a bolt portion 50 formed on first body 10's protruding lower end, as shown in FIG. 3A, and an antenna connector 60, a female screw, receiving bolt portion 50. This antenna connector 60 is connected to an antenna feeder of a transmitting/receiving circuit.

Figure 3B:
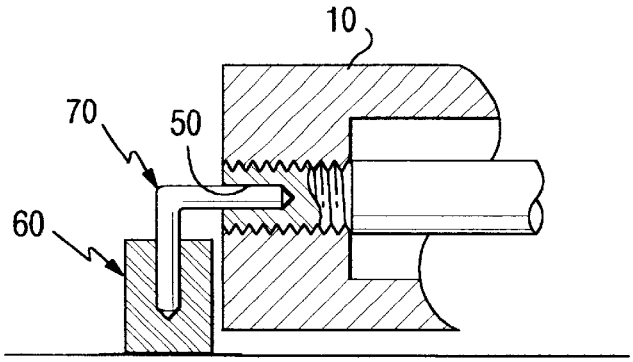

According to another feeder, as shown in FIG. 3B, each of inner core 40 and antenna connector 60 has a pin hole, and antenna connector 60's pin hole is connected to that of inner core 40, coupled to first body 10, via a pin 710 for feeding.

A common-type cellular phone terminal's circuit board is surrounded by a shield partition not to be adversely affected by external radio waves, and the inventive antenna is also installed outside of the shield partition.

Since two bodies of this antenna are electrically connected to each other through an inner core, the length of its surface is longer than its outer length. With this antenna having the shorter outer length, a desired gain and characteristics can be obtained. Thus, the inventive antenna can assure the more improved performance than a conventional loading coil-type antenna's just by installing the antenna within a case of a cellular phone terminal.

Figure 4A:
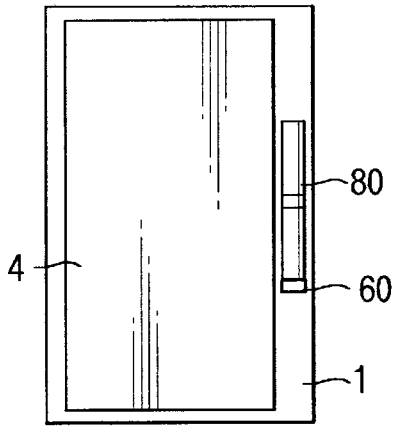
FIGS. 4A to 4E depict the position of installation of the inventive antenna.
Figure 4B:
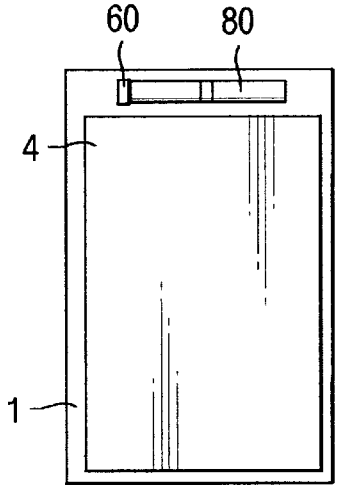

FIGS. 4A to 4F depict the position of installation of the inventive antenna. Referring to FIGS. 4A and 4B, a shield plate 4 for a circuit board is used as a cathode region, and an anode antenna 80 is installed outside of shield plate 4. This anode antenna 80 may be provided to one side or upper portion of the shield plate 4, as shown in FIGS. 4A and 4B. That is, anode antenna 80 may be mounted on the left, right, upper or lower portion.

Figure 4C:
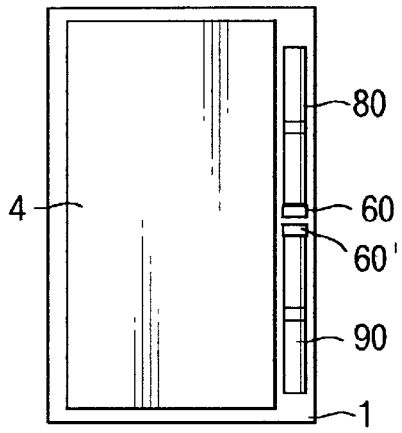
Figure 4D:
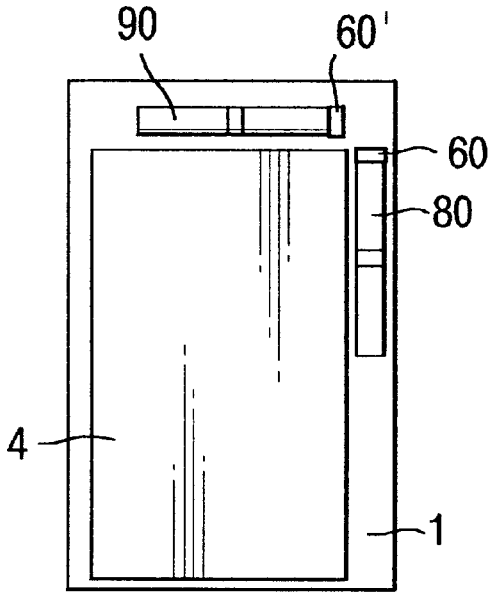

FIGS. 4C and 4D depict a cathode region designed to be similar to the anode region. As shown in FIG. 4C, two antennas 80 and 90 may be mounted on the same side as anode and cathode regions, or as shown in FIG. 4D, the anode and cathode regions can be each mounted vertically or horizontally.

Figure 4E:
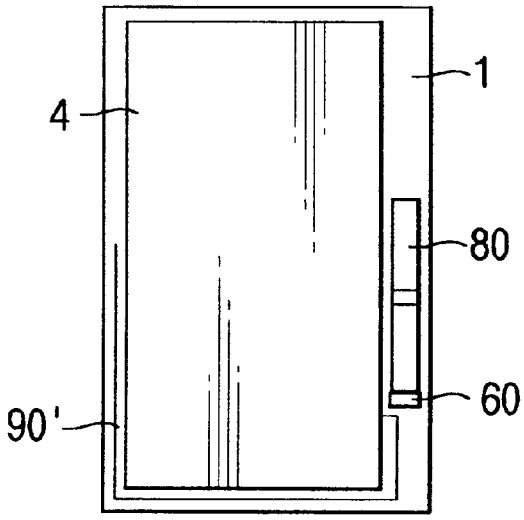

FIG. 4E shows a cathode region formed as a separate conducive pattern. As depicted in the drawing, anode antenna 80 can be mounted on one side, while the cathode conductive pattern is formed along the outside of shield plate 4.

As described above, the antenna may he mounted on one or the other side, or upper or lower portion of the cellular phone terminal, and and according to the cathode region's structure, the anode and cathode regions may be on the same or different position. The position of the inventive antenna is fixed in consideration of the size of the antenna or design of the cellular phone terminal.

Figure 5A:
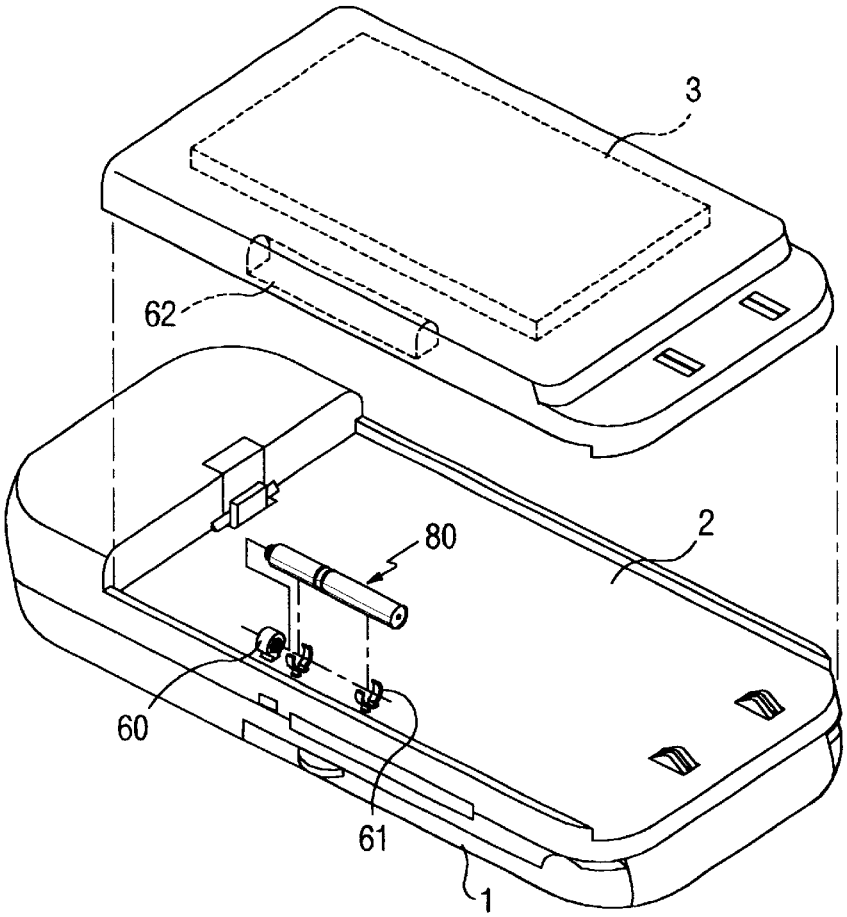
FIGS. 5A and 5B show an antenna installed in a cellular phone in accordance with another preferred embodiment of the present invention.
Figure 5B:
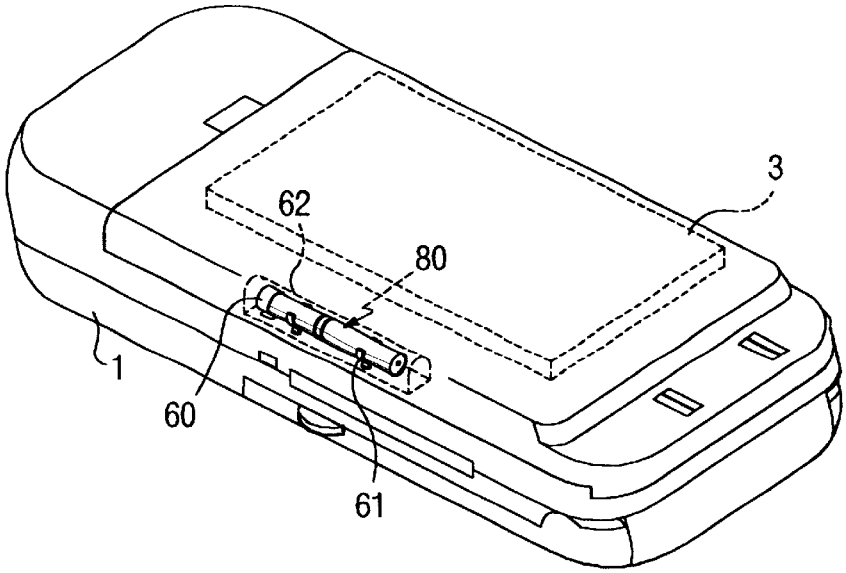

FIGS. 5A and 5B depict another structure of antenna installation in accordance with the present invention. As shown in the drawings, a circuit board surrounded by a shield plate is mounted in a front case 1 of a cellular phone terminal, and protruding antenna connector 60 are provided to a rear case 2. An antenna connector guide 61 for coupling antenna 80 to this connector 60 and fixing it is also provided to rear case 2, and a guide 62 is formed to make a battery case be in accord with the antenna coupling condition so that a battery 3 is joined to rear case 2 while antenna 80 is being coupled to rear case 2. That is, in the inventive antenna 80, guides 61 and 62 are formed in the portion where battery 3 is mounted, and antenna connector 60 is installed and battery 3 is then joined to rear case 2, whereby antenna 80 is not exposed to the outside. This antenna is designed not to be shielded by a metal.

The inventive antenna is installed outside of shield plate 4 and mounted within the cellular phone terminal case by joining first body 10 to antenna connector 60 electrically connected to the circuit board's transmitting/receiving circuit. This folding antenna is 20 to 65 mm in outer length and 3 to 6 mm in diameter, which assures a desired gain. Thus, this antenna can be easily installed on any position of the case and does not affect adversely the size design for being mounted within the terminal.

Mounting the inventive antenna in the cellular phone terminal's case does not increase the terminal's size, and the present invention can assure more improved performance than the loading coil antenna's.

As another preferred embodiment of the present invention, the inventive antenna can be used for a mobile communications terminal for automotive vehicle. In this preferred embodiment an antenna employed for an automotive vehicle is described by way of example, and the present invention may be used for a vessel's antenna, TRS equipment, an antenna for general communications, R.T.V. wireless equipment, a bar antenna, a radiotelephonic antenna.

Figure 1:
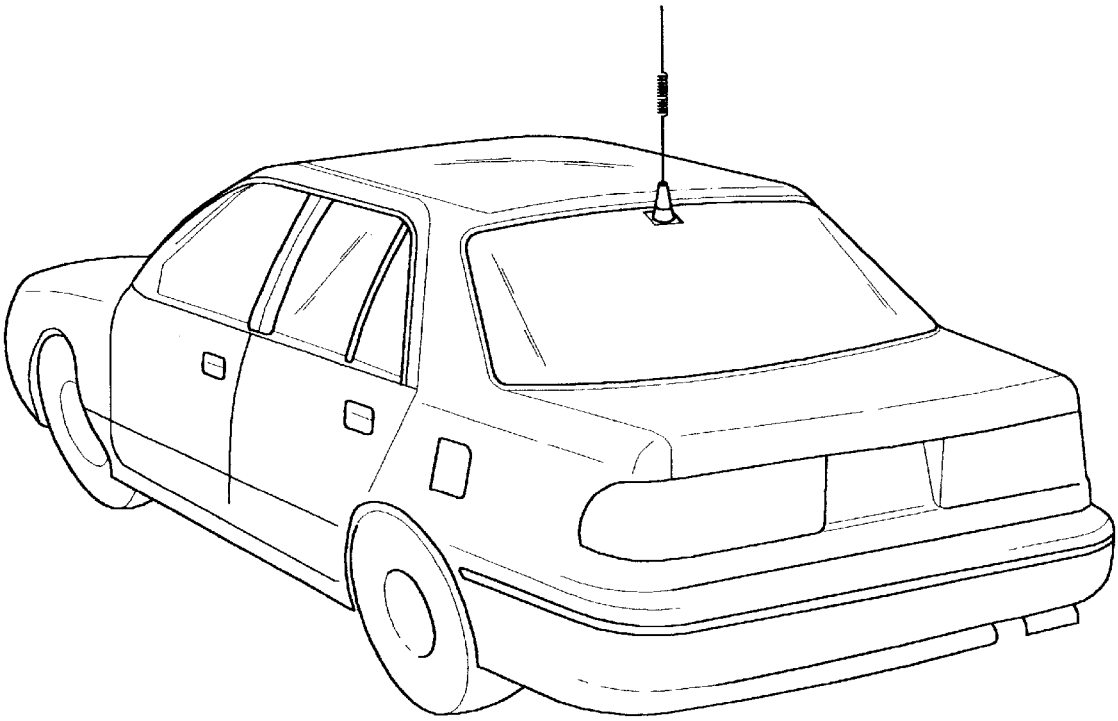
FIG. 1 (PRIOR ART)
FIG. 1 depicts a conventional on-glass antenna mounted on an automotive vehicle.
Figure 6:
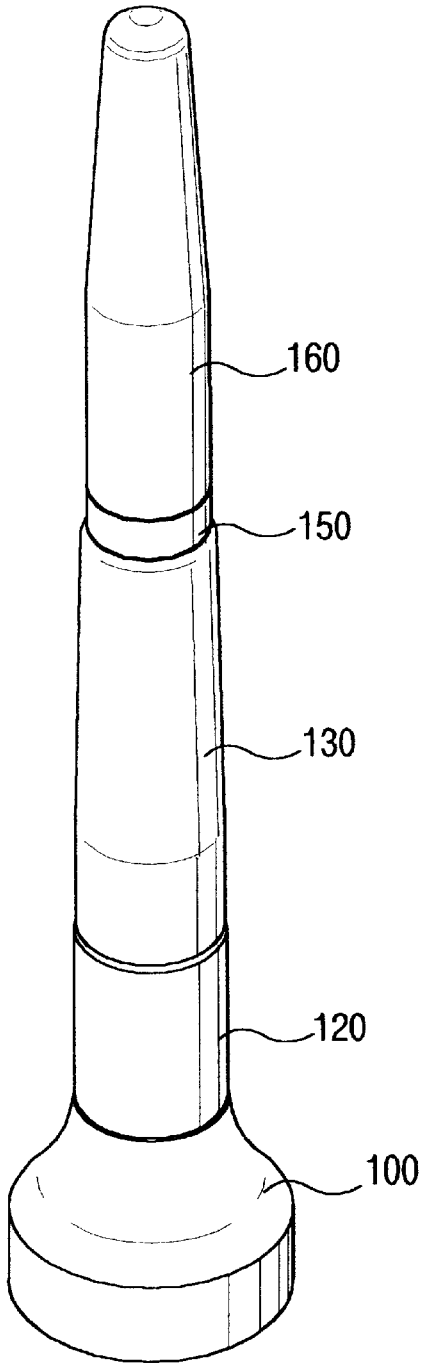
FIG. 6 is a perspective view of an antenna in accordance with a second preferred embodiment of the present invention.
Figure 7:
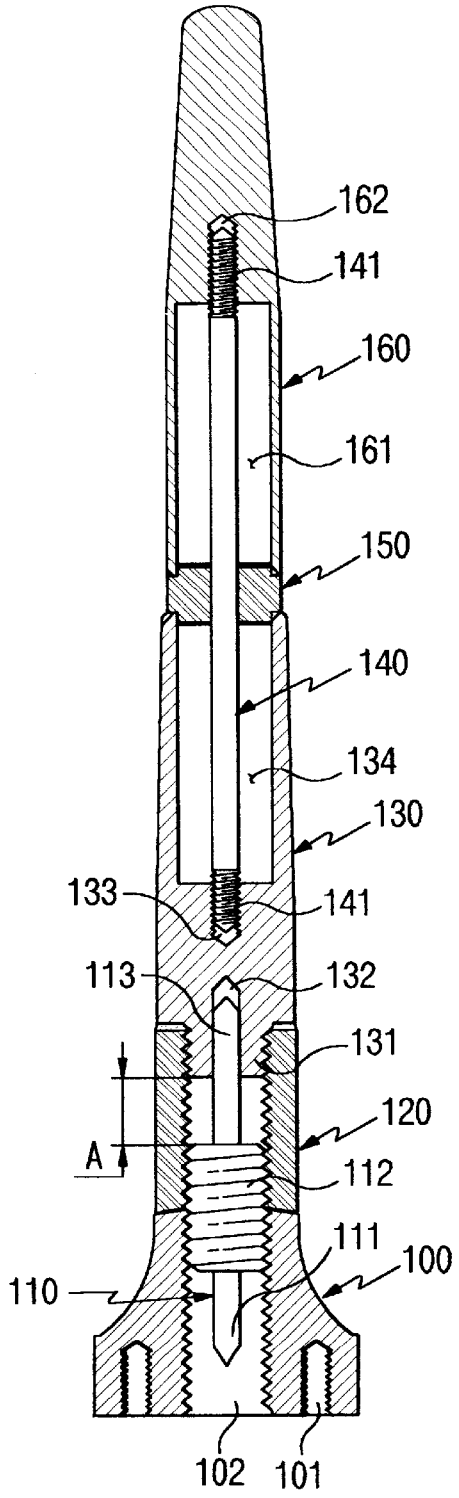
FIG. 7 is a sectional view of the interior of FIG. 6's antenna.
Figure 8:
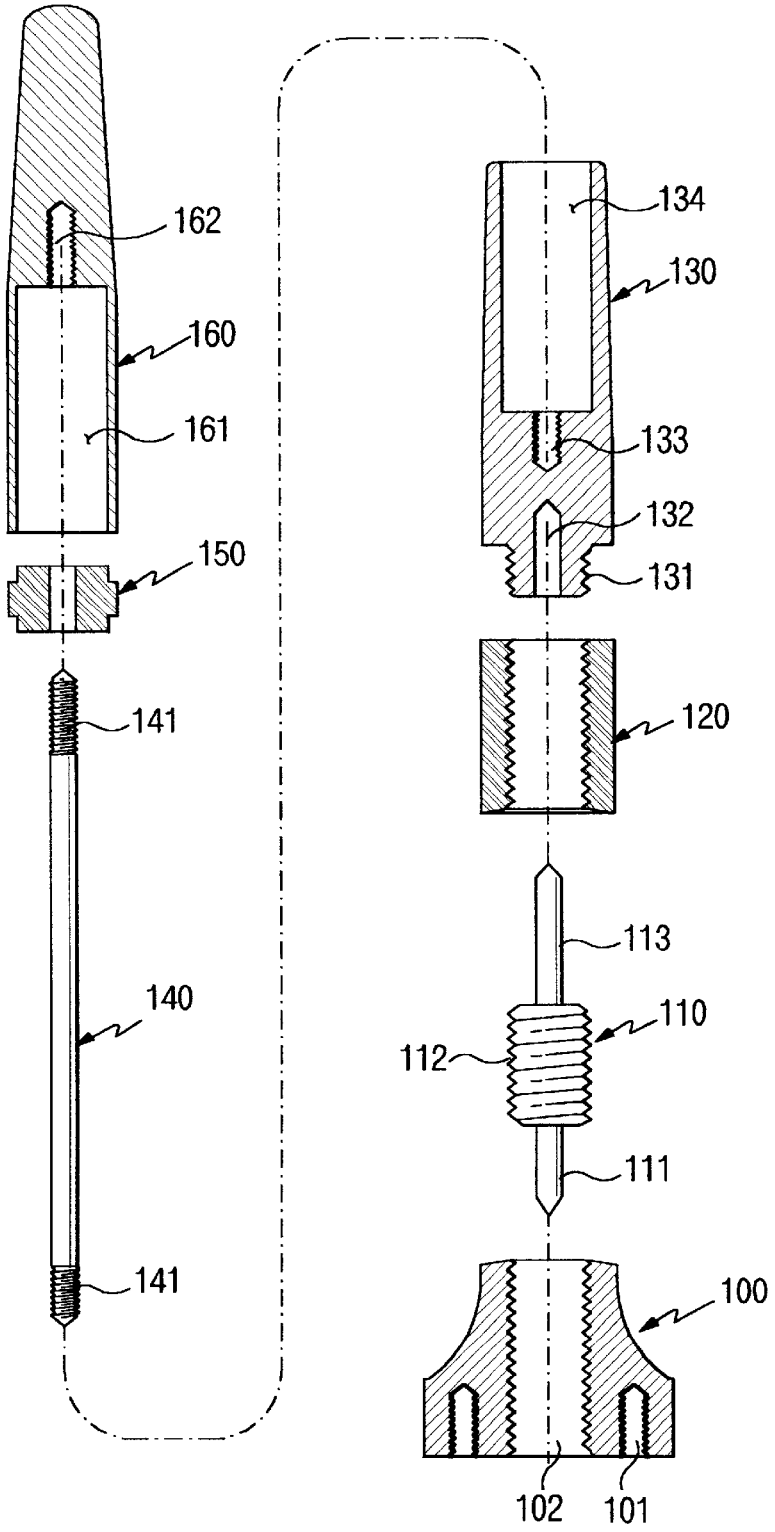
FIG. 8 is an exploded sectional view of FIG. 1.

FIG. 6 is a perspective view of an antenna in accordance with a second preferred embodiment of the present invention, and FIG. 7 is a sectional view of the interior of FIG. 6's antenna. FIG. 8 is an exploded sectional view of FIG. 1.

The antenna of this preferred embodiment includes an antenna base 100 serving as the antenna's cathode region; a connector 110 for connecting all antenna cable to an antenna body; a holder 120 keeping a space between the antenna's cathode region (base) and anode region (body) and minutely controlling the space, first and second bodies 130 and 160; first and second bodies 130 and 160 each having a groove; an inner core 140 inserted into first body 130's groove to connect first body 130 with second body 160; and a spacer 150 for keeping space between first and second bodies 130 and 160 and minutely controlling the space.

This antenna base 100 is of conical shape and has a through hole 102 with screw threads and passing upper and lower portions of base 100, and a plurality of screw races 101 on its bottom to be electrically connected to each other through a fixing bracket, thus serving as a cathode of the antenna.

Connector 110 includes a non-conductive bolt portion 112 screwed to through hole 102 of antenna base 100, and connector pins 111 and 113 each protruding to the upper and lower parts of bolt portion 112 and acting as a feeder.

In this connector 110 bolt portion 112 is screwed to the upper part of through hole 102 of antenna base 100 so that a part of it protrudes to the upper part, and an antenna cable (not shown) is electrically connected to connector pin 111 within through hole 102 of base 100. This holder 120 is a cylindrical nut holder with a diameter that is the same as base 100's upper diameter, and formed of an insulating material screwed to bolt portion 112 of connector 110 and a bolt portion 131 formed on the lower portion of first body 130.

This first body 130 has bolt portion 131 joined to holder 120 on its lower section, and a pin hole 132 is provided to bolt portion 131. Connector pin 113 is fitted into pin hole 132 for electrical connection.

A race 134 of a given depth is designed according to the antenna's transmitting/receiving frequency, and a coupling groove 133 to which inner core 140 is screwed is formed on the bottom of race 134. Each screw thread 141 is formed on both ends of inner core 140, and inner core 140's one end is screwed to coupling groove 133 of first body 130. Inner core 140is spaced a given distance away from race 134 of first body 130.

Spacer 150 with a through hole into which inner core 140 is fitted is formed of an insulating material for keeping a space between first and second bodies 130 and 160. Second body 160 has a race 161 of a given depth designed to the antenna's transmitting/receiving frequency, and a coupling groove 162 is formed on the upper section of race 161 and receives inner core 140. Inner core 140, screwed to coupling groove 162, comes in close contact with first body 130's upper part with spacer 150 therebetween.

The following description is about the steps in the assembly of the present invention.

Bolt portion 112 of connector 110 is screwed to antenna base 100's through hole 102 so that a part of bolt portion 112 protrudes to base 100's upper section, and holder 120 is screwed to bolt portion 112 of connector 110, projecting to base 100's upper section. Bolt portion 131 is screwed to holder 120, simultaneously with inserting a connector pin 113 of connector 110 into pin hole 132 of first body 130's bolt portion 131. Inner core 140 is screwed through race 134 from the upper part of first, body 130. Spacer 150 is fitted into inner core 140, and the upper section of inner core 140 is screwed to coupling groove 162, provided to second body 160's race 161.

Spacer 150 may be joined to inner core 140 by forming projecting portions for being fitted into race 134 and race 161.

Once the above assembly is completed, the antenna cable is inserted into antenna base 100's through hole to electrically connect the antenna cable with connector pin 111, and after antenna base 100 is electrically grounded, the interval between first body 130 and antenna base 100 is minutely controlled by turning holder 120 while checking the antenna's performance. Holder 120 is set by the use of an adhesive agent and the like at the point where optimum performance is achieved whereby the interval between first body 130 and antenna base 100, i.e. The overall length of the antenna is set.

In addition, after the antenna characteristics are controlled by minutely regulating a coupling space between races 134 and 161 of first and second bodies 130 and 160 via spacer 150, it is fixed by the use of an adhesive agent.

The space (refer to FIG. 3A) is regulated by using holder 120 in the production line, thus minutely controlling the RFC. Finally, the VSWR is adjusted to about 1.0 (refer to table 1).

Accordingly, the RFC is adjusted to about 1.0 the VSWR, as shown in table 1. The smaller the value becomes, the more the antenna performance is excellent. The antenna's gain of the present invention is greater than the other products', as shown in table 1. In table 1 the inventive antenna is compared to the conventional on-glass antennas A, B and C in gain and VSWR.

TABLE 1

| | VSWR | | | | | |
|---|---|---|---|---|---|---|
| | This | A | | B | | C |
| Frequency (MHz) | Invention | Sample 1 | Sample 2 | Sample 1 | Sample 2 | Sample 1 |
| 824 | 3.85 | −0.4 | −0.2 | −0.1 | 0.1 | 1.12 |
| 836 | 4.55 | 1.6 | 1.3 | 0.8 | 1.2 | 1.3 |
| 848 | 5.15 | 0.2 | −0.2 | 0.0 | 0.3 | 0.0 |
| 869 | 4.05 | 0.2 | −0.1 | −0.6 | −1.0 | 0.3 |
| 881 | 4.25 | −0.1 | −1.2 | −2.3 | −2.5 | −0.5 |
| 894 | 3.45 | −0.1 | −0.7 | −0.2 | −0.4 | 0.4 |
| average | 4.21 | −0.1 | −0.2 | −0.4 | −0.4 | 0.2 |
| 824 | 1.12 | 1.52 | 1.36 | 1.20 | 1.09 | 1.30 |
| 836 | 1.05 | 1.48 | 1.42 | 1.34 | 1.27 | 1.54 |
| 848 | 1.05 | 1.66 | 1.65 | 1.46 | 1.30 | 1.67 |
| 869 | | 1.51 | 1.47 | 1.57 | 1.40 | 1.73 |
| 881 | | 1.23 | 1.37 | 1.51 | 1.42 | 1.62 |
| 894 | | 1.07 | 1.02 | 1.40 | 1.37 | 1.46 |
| average | 1.07 | 1.41 | 1.38 | 1.41 | 1.31 | 1.55 |

The antennas appeared in table 1 are not the same as each other in length. Each of A, B and C antennas is about 450 to 475 (+/−10)mm, and the length of the antenna is about 123 mm. The present invention is remarkably shorter than the other products, and assures the excellent gain characteristics and VSWR.

First and second bodies 130 and 160 of the inventive antenna have races 134 and 161, respectively, and the antenna's transmitting/receiving frequency is amplified in the races and inner core and transmitted/received around spacer 150. Therefore, the overall length of the antenna can be reduced.

According to this invention, since each hole is provided to the first and second bodies to enhance the output characteristics, the length of the antenna can be decreased even in a broadband. The depth of each race provided to the bodies and the length of the inner core are added to the length of the outer surface, thus forming the overall length of the antenna. The outer length of antenna base 100, holder 110, first body 130, spacer 150 and second body 160 becomes the outer length of the inventive antenna. Therefore, the overall outer length of the antenna can be significantly reduced compared to the conventional antenna's length.

The structure of the present invention having the races creates the corresponding RFC between the core and the surface of each race to cause phase inversion and RF amplification.

The inventive antenna does not need to be loading-coil one, and its overall length is very short to assure low RFR, low radiation resistance, and high efficiency. In addition, since the present invention employs the holder system, ANT TOP 101A (refer to table 1) has broadband characteristics (806 MHz to 1.87 GHz), and R, CDP, PCS shared antenna may be used with one antenna.

Figure 9:
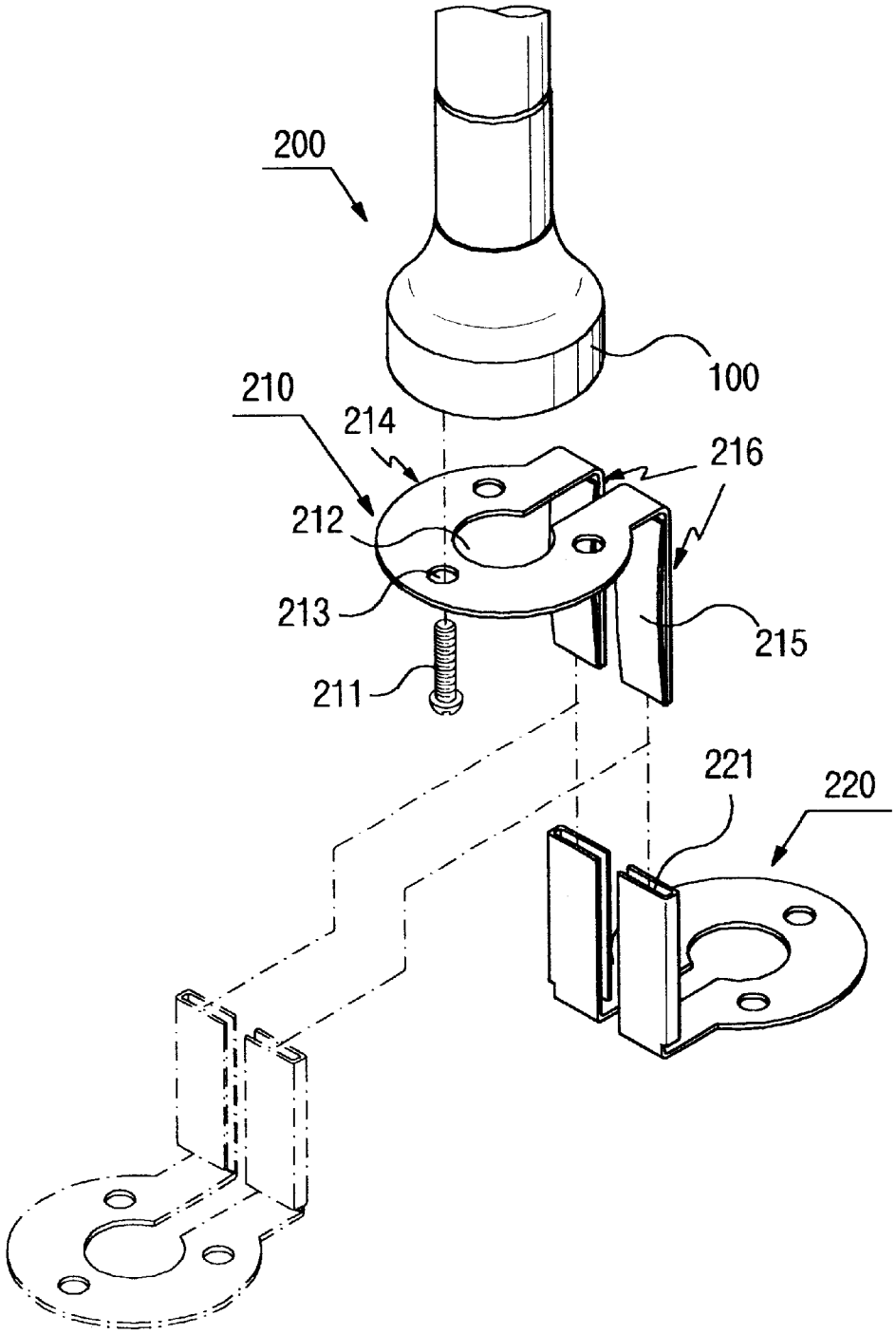
FIG. 9 is an exploded perspective view of antenna fixing brackets in accordance with the present invention.

FIG. 9 is an exploded perspective view of antenna fixing brackets in accordance with the present invention.

As shown in the drawing, fixing disk 214, corresponding to the bottom of antenna base 100, has a plurality of screw holes 213 to which screws 211 are fastened, and a cable guide hole 212 is formed to receive the antenna cable. A coupling part 216 is formed on one side of fixing disk 214 to be curved by a given angle (e.g. right angle) and divided into two by an open slit connected to guide hole 212 in such a manner that first and second fixing brackets 210 and 220 are formed. Elastic pieces 215 with compressed elastic force are attached to coupling part 216 of first fixing bracket 210, and second fixing bracket 220's coupling part 216 has a coupling slot 216 into which elastic pieces 215 of first fixing bracket 210 are fitted.

Since first and second fixing brackets 210 and 220 are in pairs, while one of them is fixed by antenna base 100 and screw 211, the other one is inserted into a certain position within a car (e.g. a gap of a car audio or car air-conditioner). This antenna can be easily installed by joining the coupling part of the fixing bracket with antenna base 100 to the coupling part the bracket this is fixed to the car's interior. In addition, since the fixing brackets that are in pairs are not directional, they may be joined as indicated by the dotted line of FIG. 9.

This preferred embodiment of FIG. 9 is not limited to the above-described type, and these brackets may be mounted on the outside of the car. Another type of fixing brackets may be used. Since the fixing brackets are electrically connected with antenna base 100 and serve as an antenna cathode, fixing brackets designed according to those characteristics will do.

The inventive antenna may be mounted in the car, and connector 120 within antenna base 100 can be directly coupled to a hands-free connector as a pin type. Therefore, hands-free antenna cable connector can be directly inserted into the interior of antenna base 100 without using an extra connecting cable.

The conventional antennas cannot not be installed in a car because of their big size, and use cables for connection of hands-free connectors, which results in one more connector coupling, and increases the cable's length. This causes noise and deterioration of performance.

The present invention has the following advantages.

First, the antenna's overall parts can be mechanically (bolt-nut type) assembled by using thee standardized components and the antenna without soldering in the assembly step, thus enhancing the productivity.

Second, the antenna's length can be reduced with respect to the broadband frequency.

Third, the antenna's VSWR can be set to about 1.0, and its gain is higher than the conventional one's thereby enhancing the performance.

Fourth, since the antenna for a cellular phone terminal is installed in the terminal's case, this terminal can be variously designed, and obviates any inconvenience that may occur by the projecting antenna.

It will be apparent to those skilled in the art that various modifications and variations can be made in the antenna for mobile communications of the present invention without departing from the spirit or scope of the invention. Thus, it is intended that the present invention cover the modifications and variations of this invention provided they come within the scope of the appended claims and their equivalents.

What is claimed is:

1. An antenna for mobile communications comprising:

first and second bodies of conductor, each having races whose length and diameter are designed in consideration of the antenna's frequency and gain characteristics;

a spacer of a non-conductor interposed between the first and second bodies so as to keep a given space between the respective races of the first and second bodies according to the frequency and gain characteristics;

an inner core fixing two bodies to each other with screwed parts respectively inserted into screwed grooves each passing through the races' bottom, and electrically connecting the first body to the second body; and a coupling part for feeder connection of a transmitting/receiving terminal.

2. An antenna for mobile communications according to claim 1, wherein the coupling part has a bolt portion formed on the first body's protruding lower end, and a female screw joining an antenna connector connected to an antenna feeder of a transmitting/receiving circuit to the bolt portion.

3. An antenna for mobile communications according to claim 1, wherein, in the coupling part, a pin hole is formed at one end of the inner core and a pin is provided to an antenna connector connected to an antenna feeder of the transmitting/receiving circuit, and the pin hole of the inner core joined to the first body is connected to the antenna connector via a pin for feeding.

4. An antenna for mobile communications comprising:

an antenna anode region including first and second bodies of conductor, each having races whose length and diameter are designed in consideration of the antenna's frequency and gain characteristics; a spacer of a non-conductor interposed between the first and second bodies so as to keep a given space between the respective races of the first and second bodies; an inner core having both ends screwed to each bottom of the races of the first and second bodies to fix two bodies to each other, and electrically connecting the first body to the second body; and a coupling part formed on the first body's lower portion and electrically connecting to a cellular phone's circuit board; and an antenna cathode region formed as the circuit board, corresponding to the, antenna anode region, said antenna being mounted in a cellular phone terminal's case.

5. An antenna for mobile according to claim 4, wherein the antenna cathode region is designed to be an extra conductive pattern outside of the shield plate.

6. An antenna for mobile according to claim 4, wherein the antenna cathode region is of the same structure as that of the antenna anode region of which two bodies each having races are spaced a given distance away from each other by a holder and fixed by the inner core, and connected to each other by the coupling part and an antenna connector, said antenna cathode region being installed within the cellular phone terminal's case along with the antenna anode region.

7. An antenna for mobile according to claim 6, wherein the antenna cathode region makes a right angle to the antenna anode region.

8. An antenna for mobile according to claim 4, wherein each of the antenna's coupling part and the antenna connector has a pin hole, and said antenna is electrically connected by a pin inserted into each pin hole of the coupling part and the antenna connector.

9. An antenna comprising:

an antenna base having a through hole into which an antenna cable for communications equipment is inserted, and a plurality of screw holes formed on its bottom to mate with fixing brackets;

a connector having a bolt portion joined to the through hole's upper section, and a connector pin protruding to the bolt portion's upper and lower parts, a part of the bolt portion being screwed to the through hole of the antenna base, and the antenna cable, inserted into the antenna base, being electrically connected to the connector pin protruding to the lower part;

a holder of an insulating material, screwed to the bolt portion of the connector protruding to the upper part of the antenna base, and precisely controlling a minute space between the bolt portion's upper section and an antenna body for regulating the antenna's capacitance;

a first body having a bolt portion protruding from its lower portion and joined to the holder, said bolt portion having a pin hole into which a connector pin projecting to the connector's upper part is inserted for electrical connection, and a race of a given depth designed according to the antenna's transmitting/receiving frequency and gain, said race having screwed grooves on its bottom;

an inner core having one end screwed to the screwed grooves, and spaced a given distance away from the inner surface of the first body's race;

a holder of cylindrical shape having a through hole through which the inner core passes, and formed of an insulating material keeping a space of the first and seconds bodies, designed according to the antenna's transmitting/receiving frequency and gain; and a second body having a race corresponding to the first body's, screwed grooves formed on its inner upper section, for receiving the inner core, and a cap formed on its outer upper section.

10. An antenna according to claim 9, wherein the holder is fixedly set by an adhesive agent after minutely controlling a space between the first body and the bolt portion of the connector fixed to the antenna base in order to regulate the antenna's capacitance.

11. An antenna according to claim 9, wherein each of the fixing brackets includes a fixing disk, corresponding to the bottom of the antenna base, having a plurality of screw holes to which screws are fastened, a cable guide hole formed to receive the antenna cable, and a coupling part formed on one side of the fixing disk to be curved by a given angle and divided into two by an open slit connected to the guide hole in such a manner that the first and second fixing brackets, elastic pieces with compressed elastic force being attached to the coupling part of the first fixing bracket, and the second fixing bracket's coupling part having a coupling slot into which the elastic pieces of the first fixing bracket are fitted, so that said brackets are either fixedly inserted into a gap of a car's interior into which the fixing disk can be fitted, or fixedly installed inside or outside of the car by using screws.

12. An antenna comprising:

a first body having a race and a coupling groove at a distal end;

a second body having a race and a coupling groove at an opposite distal end;

a spacer interposed between the first body and the second body as to maintain a given space between respective races of the first body and the second body according to frequency and gain characteristics of the antenna; and an inner core having respective distal ends fixedly coupled to the respective coupling grooves of the respective races of the first body and the second body as to electrically connect the first body to the second body.

13. An antenna according to claim 12, further comprising a coupling unit arranged to couple the lower end of the antenna to an antenna feeder of a transmitting/receiving circuit.

14. An antenna according to claim 13, wherein said coupling unit comprises an antenna connector having a female screw arranged to receive the lower end of the antenna for connection to the antenna feeder of the transmitting/receiving circuit.

15. An antenna according to claim 13, wherein said coupling unit comprises an antenna connector having a pin hole arranged to couple to the distal end of the inner core, via a pin, for connection to the antenna feeder of the transmitting/receiving circuit.

16. An antenna according to claim 12, wherein the respective races of the first body and the second body have respective length and diameter designed according to the frequency and gain characteristics of the antenna.

* * * * *